US006021820A

United States Patent [19]

Cox

[11] Patent Number: 6,021,820

[45] Date of Patent: Feb. 8, 2000

[54] WEAVING DEVICE WITH PRACTILE FLUID HANDLING

[75] Inventor: Gerard Cox, Deurne, Netherlands

[73] Assignee: Texo A.B., Almhult, Sweden

[21] Appl. No.: 08/941,029

[22] Filed: Sep. 30, 1997

[30] Foreign Application Priority Data

Oct. 2, 1996 [NL] Netherlands ..... 1004173

[51] Int. Cl.[7] ..... D03D 49/42; D03D 47/24

[52] U.S. Cl. ..... 139/435.1; 139/435.6; 139/435.5; 139/196.2; 139/448

[58] Field of Search ..... 139/204, 435.5, 139/435.6, 196.1, 196.3, 448, 197, 438, 439, 196.2, 435.1, 437, 144; 244/206, 204

[56] References Cited

U.S. PATENT DOCUMENTS

| | | | |
|---|---|---|---|
| 3,461,919 | 8/1969 | Wueger . | |
| 3,794,274 | 2/1974 | Eknes | 244/130 |
| 3,831,640 | 8/1974 | Wueger . | |
| 4,194,539 | 3/1980 | Griffith | 139/196.3 |
| 4,245,677 | 1/1981 | Suzuki . | |
| 4,304,269 | 12/1981 | Suzuki . | |
| 4,401,139 | 8/1983 | Koriyama et al. | 139/435.1 |
| 4,442,871 | 4/1984 | Suzuki . | |
| 4,448,222 | 5/1984 | Arakawa | 139/435.1 |
| 5,860,626 | 1/1999 | Moser | 244/200 |

FOREIGN PATENT DOCUMENTS 7 309 850 1/1974 Netherlands .

*Primary Examiner*—Andy Falik
*Attorney, Agent, or Firm*—Pennie & Edmonds LLP

[57] ABSTRACT

A weaving device utilizing a projectile and a pressurized medium to guide the projectile as it transports a weft thread from a supply spool through a section of warp threads. A device is also used to introduce and decelerate the projectile. The pressurized medium passes through outlet openings in a plurality of spaced apart guides and moves the projectile by acting upon a plurality of annular recesses on the surface of these projectiles. Further, as the pressurized medium strikes these annular recesses, a pressure build up takes place in the spaces of the annular recesses to create a boundary of air which reduces friction between the projectile and the guides, and which increases the stability of the projectile.

11 Claims, 4 Drawing Sheets

WEAVING DEVICE WITH PRACTILE FLUID HANDLING

BACKGROUND OF THE INVENTION

The present invention relates to a weaving device comprising a sley and means for forming a weft section of warp threads, whereby a device for introducing and decelerating respectively a projectile for transporting a weft thread from a supply spool through the section of warp threads is disposed on one or on both sides of said weft section, whereby a plurality of spaced-apart guides are present on said sley, which guides function to guide the projectile within the section of warp threads.

Weaving devices of the kind referred to above are generally known and are for example described in Dutch Patent Application No. 73 09 850 and U.S. Pat. No. 3,831,640. With this type of weaving devices a weft thread is attached from a supply spool to a projectile, also referred to as shuttle, which projectile is launched from the introducing station and transported through the weft section via guides disposed in said weft section. With the device according to the aforesaid Dutch patent application the guides and the projectile are thereby designed in such a manner that an aerodynamic layer of air is created between the projectile and the guides during the transport of said projectile through said guides, resulting in a reduced friction between said projectile and said guides.

A drawback of this known device is that all the energy that is required for the transport of the projectile through the weaving section must be imparted to the projectile at the start of the movement, in the introducing station, therefore. In order to be able to transport the projectile through a weaving section of reasonable width, a very great amount of energy needs to be imparted to the projectile at the start of its movement, which means using a very high starting velocity, which in turn results in high peak stresses in the weft thread to be transported. Furthermore this means that the projectile needs to have a relatively high mass of its own.

SUMMARY OF THE INVENTION

The object of the invention is to provide a weaving device of the kind indicated above, which obviates said drawback and wherein a better guiding and stabilisation of said projectile is achieved and wherein said projectile can be passed through the weaving section with a variable velocity profile as a result of transport energy being supplied during said passage through the weaving section.

In order to accomplish this objective the weaving device according to the invention is characterized in that at least a number of said guides are in the form of hollow medium blowers, to which a pressurized medium can be supplied, and which are provided with one or more outlet openings, which are directed in such a manner that the outflowing medium strikes a wall of a projectile to be guided, which projectile is provided with striking surfaces for the medium flows in question.

With the device according to the invention at least a number of said guides are in the form of hollow medium blowers. Said medium may be gaseous, for example air, but it is also possible to use a liquid, such as water, as the medium. The medium blowers are thereby provided with a number of outlet openings, which are directed in such a manner that the medium exiting therefrom strikes a projectile to be transported over said guides. The medium flowing against the striking surfaces of the projectile thereby transfers transport energy to the projectile, so that said medium blowers contribute to the velocity of said projectile. This means that all the energy required for transporting the projectile through the weaving section needs not to be imparted to the projectile at the beginning of the weaving section. Furthermore this means that, because the medium blowers impart transport energy to the projectile continuously during its transport through the weaving section, there is actually no limit to the width of the weaving section. Besides transporting the projectile the outflowing medium also provides a satisfactory guiding of said projectile, because a layer of medium is created between said guide and said projectile, as it were, thus reducing the amount of friction. Thus a weaving device has been obtained wherein the projectile can be moved through the weaving section with very little friction and at a constant velocity, or at a controlled variable velocity, if desired. A controlled variable velocity may be achieved by regulating the amount of medium supplied to the auxiliary blowers and/or by varying the outflow direction of the blowing device. Since it is no longer necessary with the device according to the invention to impart all energy which is required for the transport of the projectile through the weaving section to the projectile at the beginning of the weaving section, the stresses occurring in the weft thread will remain within bounds. The position of the medium blowers and thus the path which the projectile follows through the weaving section can be selected optimally in relation to the other weaving parameters.

In order to be able to impart energy to the projectile over the entire width of the weaving section, another embodiment of the device according to the invention is characterized in that the guides in the form of medium blowers are spaced apart by a distance which is at most equal to the length of a projectile to be guided. In this embodiment at least one guide in the form of a medium blower will cooperate with the projectile at all times, so that transport energy can be continuously imparted to the projectile.

In another embodiment each of the guides in the form of medium blowers is made up of a base portion, which is secured to the sley and which connects to a medium inlet there, and of a head portion, which can be introduced into the section and which is substantially circular, seen in cross-sectional view of said section, whereby a hollow projectile having an inside diameter which substantially corresponds with the shape of said head portion can be passed over said head portion, whereby said head portion is provided, at least in one of its side faces, with one or more outlet openings, which are directed outwards with respect to the central axis of said head portion, so that outflowing medium is directed at the inner wall of a projectile passed thereover, whereby the inner wall of the projectile to be guided is provided with annular recesses, each recess having at least one wall, which, seen in the direction of transport, forms a front boundary of the respective recess.

In another embodiment the head portion of each medium blower that may be introduced into said section is provided with an opening through which a projectile can be passed, whereby said head portion, in at least one side face thereof, is provided with one or more outlet openings, which are directed obliquely towards the central axis of the openings, so that the outflowing medium strikes an outer wall of a passing projectile, whereby the outer wall of each projectile is provided with annular recesses each comprising at least one wall, which forms a front boundary of the respective recess, seen in the direction of transport.

In the above embodiments according to the invention the medium flowing from the guides in the form of medium blowers hits striking surfaces of the projectile, which have been obtained by forming annular recesses in the relevant wall of the projectile, at least one wall of said recesses forming a boundary which is located at the front, seen in the direction of transport. The medium flowing against said striking surfaces will thereby transfer energy to the projectile. In another advantageous embodiment, in order to stimulate this transfer of energy even more, each of the annular recesses in the inner wall or outer wall of a projectile to be guided is provided with a plurality of channels, through which the medium flowing against said striking wall can flow out or in, whereby said channels extend obliquely in a direction opposed to the direction of transport, so that the medium flowing in is diverted. By designing said striking surfaces and the channels connecting thereto to have a shape similar to that which is also used for turbine blades, for example, a maximum energy transfer of the outflowing medium to the projectile is achieved. In this manner an energy saving is obtained.

In another advantageous embodiment the guides in the form of medium blowers not only have medium outlet openings in one of their side faces, but also in their circumferential surface serving as a guide surface for a projectile to be guided. The medium flowing from said openings provides an adequate support and stabilization of the projectile, so that it will move over the guides with little friction.

In one embodiment of the device, wherein a hollow projectile is passed over appropriate guides with its inner side, the front and rear sides of said projectiles are according to another embodiment provided with flexible wall parts, which close the inner space and allow the projectile to pass over said guides. In this manner the medium flowing from the medium blowers and hitting the striking surfaces of the projectile will have almost no opportunity to escape from the inside of the projectile, except through the channels provided in the annular recesses of the projectile. As a result of this a very good support of the projectile is obtained, as well as an optimum transfer of the energy present in the medium to the projectile.

In another embodiment each of the guides in the form of medium blowers is connected to a medium supply line via a controllable valve, and furthermore a control device is present, which only keeps open the valves of those guides which are present within the range of a projectile to be guided. In this manner medium blowers not located within the range of a projectile are prevented from still being supplied with a medium, which medium would be lost in that case.

In order to be able to transport a projectile through a weaving section in both directions, each of the guides in the form of medium blowers is in another advantageous embodiment provided with a partition, which forms two medium channels, whereby each medium blower is on both sides provided with outlet openings, all this in such a manner that a projectile to be guided can be transported through the section in both directions. In this embodiment the parts of the medium blower positioned on either side of the partition must connect to separate medium inlets, of course, so that medium can only be supplied to that part of the medium blower which is positioned on that side of the partition which is in communication with outlet openings blowing in the desired direction of transport.

Instead of using the aforesaid two-sided medium blowers for transporting a projectile in two directions through the weaving section it is also possible to arrange the medium blowers present in the weaving section in such a manner that said blowers blow alternately in one direction and in the other direction. Furthermore it is possible to used medium blowers which are rotatably mounted on the sley, so that their blowing direction can be selected as desired.

Another energetically advantageous embodiment is characterized in that the base portion comprises a medium supply channel, which continues rectilinearly into the head portion and opens into the circumference of said head portion. In this embodiment it is not necessary for the medium in the medium blower to be diverted, but it can flow rectilinearly from the inlet to the outlet opening. Since each diversion of a medium flow leads to a loss of energy, it will be apparent that from an energy point of view this embodiment is ideal.

Although so far only guides in the form of medium blowers present in the weft section have been mentioned, in another advantageous embodiment of the device according to the invention also the introducing and/or the decelerating station disposed on one or on both sides of the weft section is (are) provided with a plurality of guides in the form of medium blowers. In this embodiment the introducing and/or decelerating of the projectile on both sides of the weft section is also carried out by medium blowers having the same shape and construction as the medium blowers disposed in the weft section. In this manner it is possible to have the introducing and/or decelerating of the projectile take place gradually, so that large peak stresses in the weft thread are avoided.

The invention furthermore relates to a projectile which is in particular suitable for being used in the above-described weaving device, the features of which are defined in the claims.

BRIEF DESCRIPTION OF THE DRAWINGS

The invention will be explained in more detail with reference to the drawings, which shows a number of embodiments by way of illustration.

DETAILED DESCRIPTION OF THE INVENTION

Figure 1:
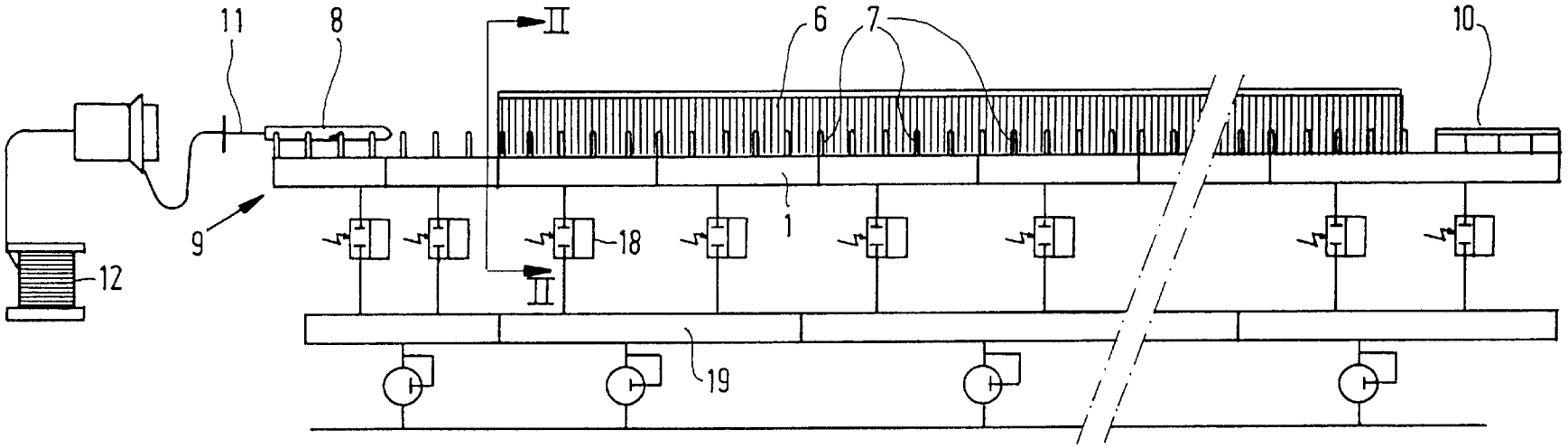
FIG. 1 is a schematic view, not to scale, of a weaving device according to the invention.
Figure 2:
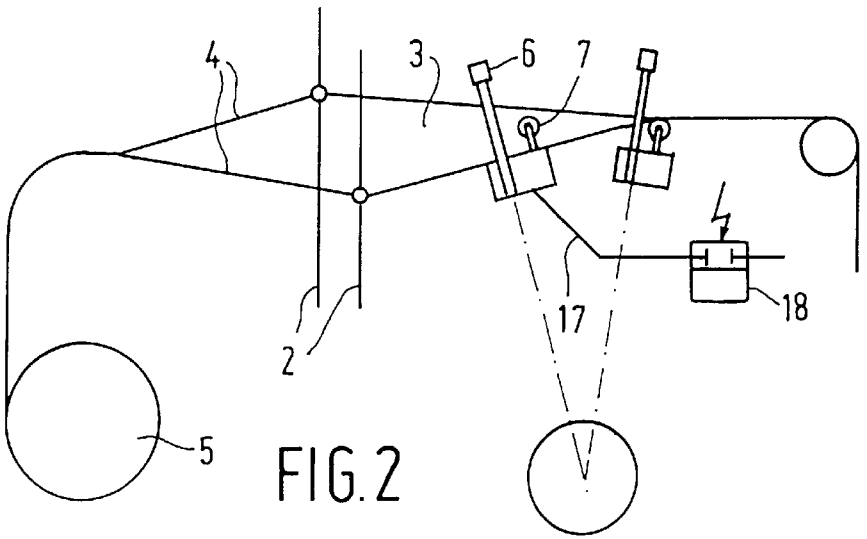
FIG. 2 is a sectional view of the device according to FIG. 1, seen along the line II—II.

FIG. 1 schematically shows a weaving device comprising a sley 1 and means 2 for forming a weft section 3 of warp threads 4, which threads 4 come from supply spools for the warp threads 5. A large number of weft means 6 are provided on sley 1, said weft means together forming the so-called reed and being capable of movement between warp threads 4. Furthermore a number of guides 7, which will be discussed in more detail hereafter, are provided on sley 1 for guiding a projectile 8 through weft section 3 from one side to the other. As is shown in the Figure, the projectile 8 is present in the introducing station 9 positioned on the left-hand side of the weft section, while a decelerating station 10 is present on the other side of the weft section. A weft thread 11 from a supply spool 12 may be connected to the projectile 8 in a known manner. The guides 7 are in the form of medium blowers, comprising a head portion 15 and a base portion 16, which is secured to sley 1 and which connects to a medium supply line 17 there. Each guide 7 may thereby connect to a main medium supply line 19 via an electromagnetic valve 18, but, as is shown in the drawing, it is also possible for a number of guides 7 lying side by side to connect to a common medium supply line 17, which in that case connects to main supply line 19 via a valve 18. The head portion 15 of guides 7 is provided with medium outlet openings 20, which are present in the side face of each of the guides 7 that lies in the direction of transport.

Figure 3A:
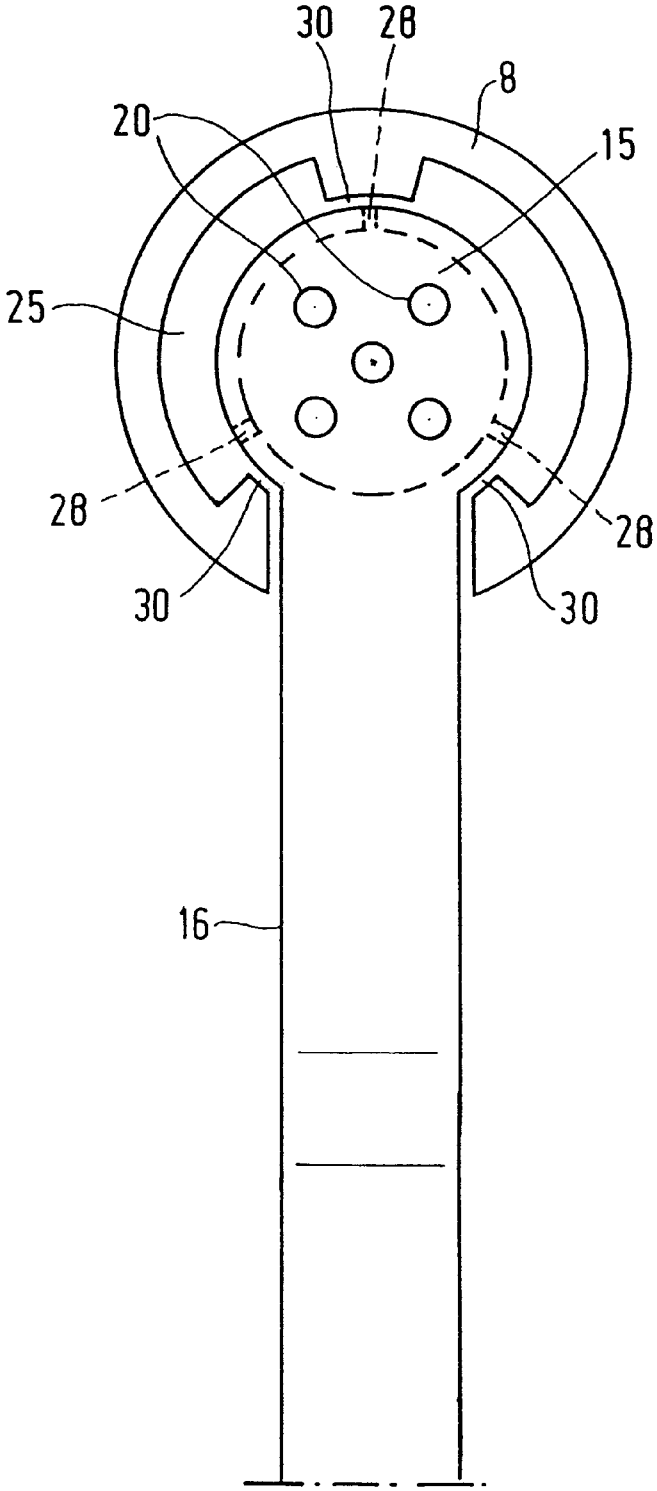
FIGS. 3*a* and 3*b* are views of one of the guides as used in the device according to FIG. 1.
Figure 3B:
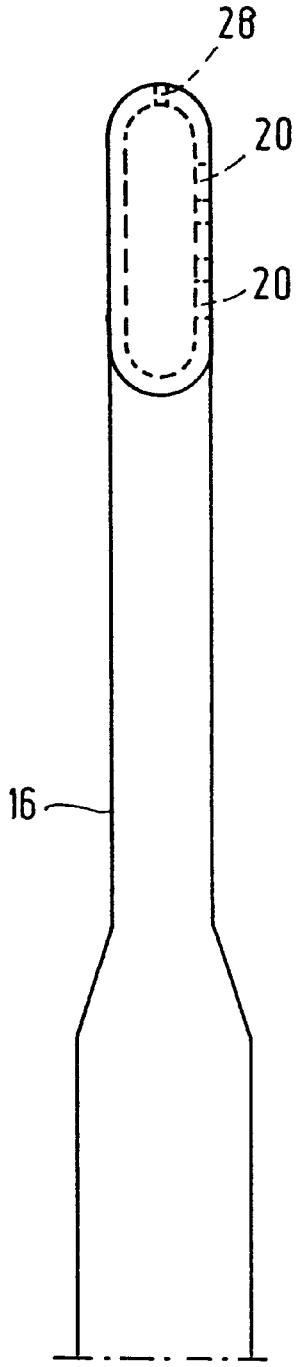
Figure 4B:
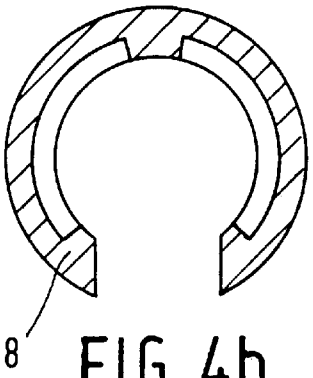
FIGS. 4*a* and 4*b* shows two mutually perpendicular sections of a projectile which can be guided on the guide illustrated in FIG. 3.
Figure 4A:
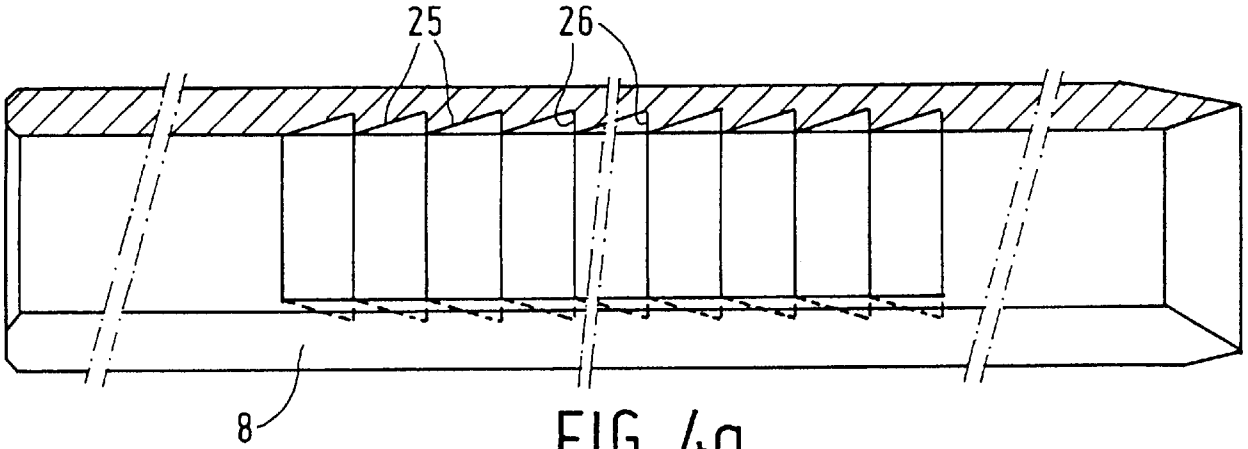

The construction of guides 7 may for example be as schematically indicated in FIGS. 3*a* and 3*b*. Said Figures show that each of the guides is made up of a base portion 16, which may be secured to sley 1 and which connects to said medium supply line. Present on the upper side of said base portion 16 is a head portion 15, which is provided with a plurality of outlet openings 20. Projectile 8, which is hollow and which cooperates with the outer wall of head portion 15 via its inner wall, can be passed over head portion 15, said head portion being circular when seen in sectional view transversely to the weaving section. The construction of said projectile may be as indicated in FIGS. 4*a* and 4*b*. As can be seen from said Figure, the inner wall of projectile 8 is provided with a plurality of annular recesses 25, which are serrated in this embodiment, each recess comprising a striking surface 26 for medium, said striking surface forming a front boundary of said serrated recess, seen in the direction of transport of the projectile. The medium outlet openings 20 in the head portion of guide 7 are thereby directed such that the outflowing medium strikes the striking surfaces 26 of the annular recesses 25. As a result of this the outflowing medium will impart energy to projectile 8, so that said projectile is transported through weaving section 3 by the outflowing medium. Furthermore, as a result of the proper enclosure of head portion 15 by projectile 8, a pressure build-up will take place in spaces 25 of the annular recesses, which create layers of medium at 30, so that said layers of air form a bearing for the projectile, as it were, which thus experiences very little friction. Furthermore medium outlet openings 28 may be provided in the circumference of head portion 15, as a result of which the medium is blown directly against the projectile. This leads to a good low-friction bearing and stabilisation of the projectile.

Figure 5B:
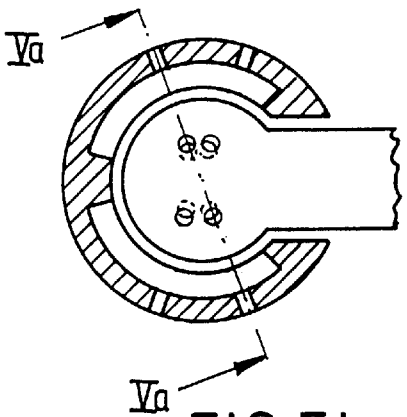
FIGS. 5*a* and 5*b* are schematic, mutually perpendicular sectional views of a guide and a projectile to be passed thereover having an embodiment different from that of FIG. 4.
Figure 5A:
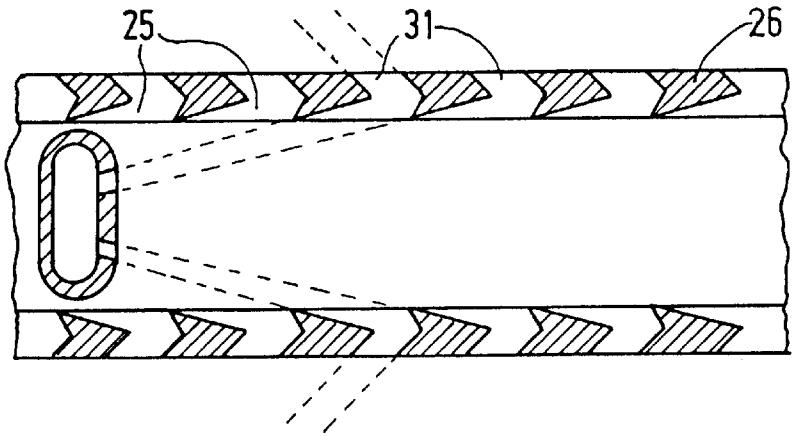

FIGS. 5*a* and 5*b* show a similar combination of guide 7 and projectile 8, with this exception that in this embodiment the annular recesses 25 are circumferentially provided with a number of channels 31, which are directed such that the medium flowing out of the recesses 25 via said channels 31 is diverted relative to the direction of transport of the projectile, so that in comparison with the embodiment of FIG. 4 more of the energy contained in the outflowing medium is transferred to the projectile. In fact, in this embodiment striking surfaces 26 and outlet openings 31 together act more or less as guide blades of a turbine.

Figures 6A, 6B, 7:
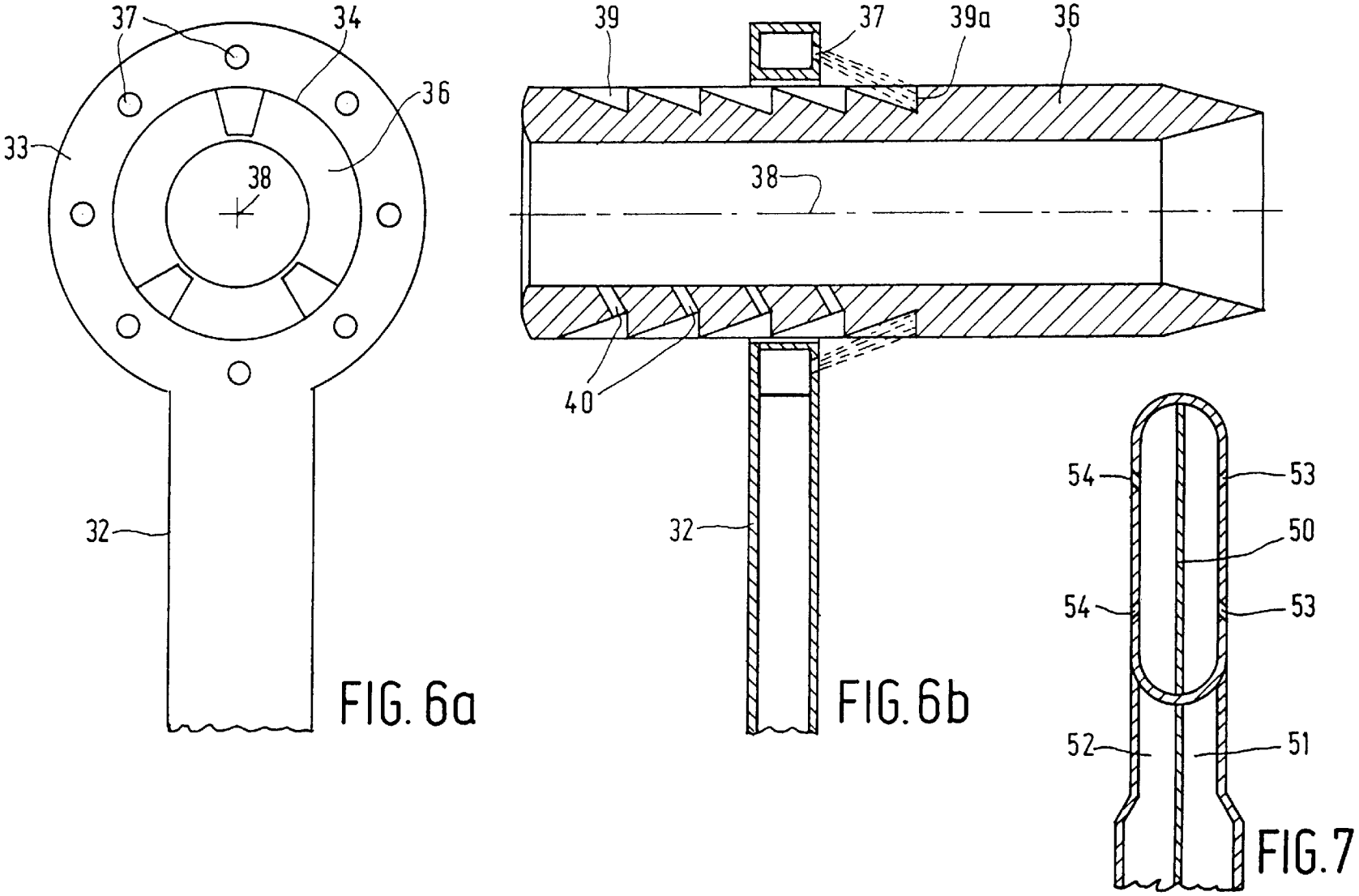
FIGS. 6*a* and 6*b* are schematic, mutually perpendicular sectional views of a guide and a projectile to be passed thereover, wherein said guide is provided with an opening through which the projectile can be passed.
FIG. 7 is a schematic sectional view of a medium blower, which is divided in two parts by a partition.

FIGS. 6*a* and 6*b* are two mutually perpendicular sectional views of an embodiment of guide 7, wherein said guide comprises a base part 32, which may be secured to sley 1 and which may be connected there to a medium supply line and a head portion 33, which is provided with an opening 34 in this embodiment, into which projectile 36 can be guided. Also in this embodiment head portion 33 is provided with a plurality of medium outlet openings 37, which are directed towards central axis 38, so that the outflowing medium strikes the outer wall of the projectile. The outer wall is thereby provided with annular recesses 39, which each have a striking surface 39*a,* which is located at the front, seen in the direction of transport. The operation of this device is the same as that of the preceding embodiments, wherein the medium flows exiting from openings 37 hit the striking surfaces 39*a,* thereby imparting transport energy to the projectile. As is the case with the embodiment according to FIG. 5, in order to further increase the energy transfer from the medium flows to the projectile, each of the rings 39 ay be provided with a plurality of openings 40 distributed over the circumference thereof, some being indicated in the drawing, which openings form channels from the annular recesses to the interior of the projectile, thereby diverting the flow of medium in such a manner that an optimum energy transfer from the medium flows to the projectile is achieved. It is also possible thereby to use medium blowers which are rotatably mounted on the sley, so that said blowers can be made to blow in the desired direction. In order to have the medium flow act on the projectile in both directions, it is possible to used guides which are arranged in spaced-apart relationship and which blow alternately in one direction and in the other direction. Furthermore it is possible thereby to use guides which are provided with a partition 50, as is schematically indicated in FIG. 7, as a result of which the channel in said guides is divided into two parts 51 and 52, which channels are connected to different medium supply lines, whereby the two sides of the guides are each provided with outlet openings 53 and 54. Depending on the direction in which the projectile is to be transported through the section, either channel 51 or channel 52 may be supplied with medium.

As is indicated in FIG. 1, both the introducing station 11 and the decelerating station 10 may be provided with a type of guides similar to guide 7, in introducing station 9 guides 7 will blow medium in the direction in which the projectile is to be transported, while in decelerating station 10 guides 7 will blow medium in the direction in which the projectile 8 is to be decelerated.

From the above it will be apparent that the invention provides a very advantageous weaving device, wherein transport energy can be imparted to the projectile during its passage through the weaving section by means of guides in the form of medium blowers. This makes it possible to maintain a constant velocity of the projectile through the entire weaving section. Furthermore it is possible, if desired, to regulate the supply of medium to the various medium blowers in such a manner that a controlled velocity profile is imparted to the projectile.

Although the invention has been explained above by means of a projectile to which one end of a weft thread is connected, the same advantages are obtained when the invention is used with projectiles in the form of real shuttles, which carry along a predetermined supply of thread during their passage through the section.

Furthermore the path of the projectile through the weaving section does not need to be rectilinear, but also curved paths, for example circular paths, are possible.

I claim:

1. A weaving device comprising a projectile, a sley and means for forming a weft section of warp threads, whereby a device for introducing and decelerating respectively said projectile for transport of a weft thread from a supply spool through the section of warp threads is disposed on one or on both sides of said weft section, whereby a plurality of spaced-apart guides are present on said sley to move said projectile within said section of warp threads, characterized in that at least a number of said guides are in the form of medium blowers provided with a partition which forms two medium channels, wherein each medium channel is provided, on each side, with outlet openings for guiding said projectile in either of two opposite directions, and to which a pressurized medium can be supplied, and which are provided with one or more outlet openings, which are directed in such a manner that outflowing medium from said outlet openings strikes at least one wall striking surface of said projectile.

2. A weaving device comprising a projectile, a sley and means for forming a weft section of warp threads, whereby a device for introducing and decelerating respectively said projectile for transport of a weft thread from a supply spool through the section of warp threads is disposed on one or on both sides of said weft section, whereby a plurality of spaced-apart guides are present on said sley to guide the projectile within said section of warp threads, characterized in that at least a number of said guides are in the form of medium blowers, to which a pressurized medium can be supplied, and which are provided with one or more outlet openings, which are directed in such a manner that outflowing medium from said outlet openings strikes a wall striking surface of said projectile to be guided, which projectile is provided with at least one striking surface for said outflowing medium, each of said guides in the form of medium blowers being made up of a base portion, which is secured to the sley and which connects to a medium inlet, and of a head portion having side faces, which can be introduced into the section and which is substantially circular, seen in cross-sectional view of said section, whereby said projectile is hollow and has an inner wall and inside diameter which substantially corresponds with the shape of said head portion can be passed over said head portion, whereby said head portion is provided, at least in one of said side faces, with one or more outlet openings, which are directed outwardly with respect to a central axis of said head portion, so that outflowing medium from said outlet openings is directed at said inner wall of said projectile passed thereover, whereby the inner wall of the projectile to be guided is provided with annular recesses, each recess having at least one wall section, which, seen in the direction of transport, forms a front boundary of the respective recess.

3. A weaving device according to claim 2, characterized in that each of the guides in the form of medium blowers is furthermore provided with one or more medium outlet openings in its circumferential surface, which serves to guide said projectile.

4. A weaving device according to claim 2, characterized in that each of the annular recesses in the said wall of said projectile to be guided is provided with a plurality of channels, through which said medium flowing against said wall can flow, whereby said channels extend obliquely in a direction opposed to the direction of transport, so that the medium flow is diverted.

5. A weaving device according to claim 2, characterized in that the projectile to be guided is provided with flexible wall parts at its front and rear sides, which wall parts close an inner space and allow the projectile to pass over said guides.

6. A weaving device according to claim 2, characterized in that the base portion comprises a medium supply channel, which continues rectilinearly into the head portion and opens into the circumference of said head portion.

7. A weaving device comprising a projectile, a sley and means for forming a weft section of warp threads, whereby a device for introducing and decelerating respectively said projectile for transport of a weft thread from a supply spool through the section of warp threads is disposed on one or on both sides of said weft section, whereby a plurality of spaced-apart guides are present on said sley to guide the projectile within said section of warp threads, characterized in that at least a number of said guides are in the form of medium blowers, to which a pressurized medium can be supplied, and which are provided with one or more outlet openings, which are directed in such a manner that outflowing medium from said outlet openings strikes a wall striking surface of said projectile to be guided, which projectile is provided with at least one striking surface for said outflowing medium, each of the guides in the form of medium blowers is made up of a base portion, which is secured to the sley and which connects to a medium inlet, and a head portion having side faces, which can be introduced into the section and which exhibits an opening through which said projectile can be passed, whereby said head portion, in at least one side face thereof, is provided with one or more outlet openings, which are directed obliquely towards the central axis of the openings, so that the outflowing medium from said outlet openings strikes an outer wall of said passing projectile, whereby the outer wall of each projectile is provided with annular recesses each comprising at least one wall surface, which forms a front boundary of the respective recess, seen in the direction of transport.

8. A weaving device comprising a projectile, a sley and means for forming a weft section of warp threads, whereby a device for introducing and decelerating respectively said projectile for transport of a weft thread from a supply spool through the section of warp threads is disposed on one or on both sides of said weft section, whereby a plurality of spaced-apart guides are present on said sley to guide the projectile within said section of warp threads, characterized in that at least a number of said guides are in the form of medium blowers, to which a pressurized medium can be supplied, and which are provided with one or more outlet openings, which are directed in such a manner that outflowing medium from said outlet openings strikes a wall striking surface of said projectile to be guided, which projectile is provided with at least one striking surface for said outflowing medium, each of the guides in the form of medium blowers being connected to a medium supply line via a controllable valve, said valve being connected to a control device to keep open only the valves of those guides which are present within range of said projectile to be guided.

9. A weaving device comprising a projectile, a sley and means for forming a weft section of warp threads, whereby a device for introducing and decelerating respectively said projectile for transport of a weft thread from a supply spool through the section of warp thread is disposed on one or on both sides of said weft section, whereby a plurality of spaced-apart guides are present on said sley to guide the projectile within said section of warp threads, characterized in that at least a number of said guides are in the form of medium blowers, to which a pressurized medium can be supplied, and which are provided with one or more outlet openings, which are directed in such a manner that outflowing medium from said outlet openings strikes a wall striking surface of said projectile to be guided, which projectile is provided with at least one striking surface for said outflowing medium, each of said guides in the form of medium blowers is provided with a partition, which forms two medium channels, wherein each medium channel is provided, on each side, with outlet openings for guiding said projectile in either of two opposite directions.

10. A weaving device comprising a projectile, a sley and means for forming a weft section of warp threads, whereby a device for introducing and decelerating respectively said projectile for transport of a weft thread from a supply spool through the section of warp threads is disposed on one or on both sides of said weft section and is provided with a plurality of guides in the form of said medium blowers, whereby a plurality of spaced-apart guides are present on said sley to guide the projectile within said section of warp threads, characterized in that at least a number of said guides are in the form of medium blowers, to which a pressurized medium can be supplied, and which are provided with one or more outlet openings, which are directed in such a manner that outflowing medium from said outlet openings strikes a wall striking surface of said projectile to be guided, which projectile is provided with at least one striking surface for said outflowing medium, said introducing and/or the decelerating device being disposed on one or on both sides of the weft section and being provided with a plurality of guides in the form of said medium blowers.

11. A weaving device comprising a projectile, a sley and means for forming a weft section of warp threads, whereby a device for introducing and decelerating respectively said projectile for transport of a weft thread from a supply spool through the section of warp threads is disposed on one or on both sides of said weft section, whereby a plurality of spaced-apart guides are present on said sley to move said projectile within said section of warp threads, characterized in that at least a number of said guides are in the form of medium blowers, to which a pressurized medium can be supplied, and which are provided with one or more outlet openings, which are directed in such a manner that outflowing medium from said outlet openings strikes at least one wall striking surface of said projectile, said wall striking surface having annular recesses provided with a row of regularly spaced-apart channels circumferentially provided in the wall of the projectile, said channels obliquely connecting to each of said striking surfaces, in such a manner that a medium flow directed against the striking surface in question is diverted and passed along substantially in counterflow via said channels.

* * * * *

UNITED STATES PATENT AND TRADEMARK OFFICE

CERTIFICATE OF CORRECTION

PATENT NO. : 6,021,820

DATED : February 8, 2000

INVENTOR(S) : Gerard Cox

It is certified that error appears in the above-identified patent and that said Letters Patent is hereby corrected as shown below:

Title page, item [54] and col. 1, line 1, change the title to read --WEAVING DEVICE WITH PROJECTILE FLUID HANDLING--.

Column 8, line 47 (claim 8, line 16): change "each of the guides" to --each of said guides".

Column 8, line 56 (claim 9, line 5): change "thread" to --threads--.

Signed and Sealed this

Fourteenth Day of November, 2000

*Attest:*

Q. TODD DICKINSON

*Attesting Officer*

*Director of Patents and Trademarks*